US005919593A

United States Patent [19]

Karima et al.

[11] Patent Number: 5,919,593

[45] Date of Patent: Jul. 6, 1999

[54] CARRIER FOR ELECTROPHOTOGRAPHY AND DEVELOPING MATERIAL FOR ELECTROPHOTOGRAPHY USING SAME

[75] Inventors: Yusuke Karima; Kazuo Murakata; Hiroshi Matsuo, all of Sodegaura, Japan

[73] Assignee: Idemitsu Kosan Co., Ltd., Tokyo, Japan

[21] Appl. No.: 08/973,872

[22] PCT Filed: Jun. 27, 1996

[86] PCT No.: PCT/JP96/01773

§ 371 Date: Jan. 7, 1998

§ 102(e) Date: Jan. 7, 1998

[87] PCT Pub. No.: WO97/03383

PCT Pub. Date: Jan. 30, 1997

[30] Foreign Application Priority Data

Jul. 7, 1995 [JP] Japan ..... 7-195997
Sep. 22, 1995 [JP] Japan ..... 7-244223

[51] Int. Cl.[6] ..... G03G 9/113

[52] U.S. Cl. ..... 430/108

[58] Field of Search ..... 430/108, 111, 430/122

[56] References Cited

U.S. PATENT DOCUMENTS

| | | | |
|---|---|---|---|
| 4,871,639 | 10/1989 | Aoki et al. | 430/108 |
| 5,391,451 | 2/1995 | Yoshie et al. | 430/106.6 |
| 5,427,884 | 6/1995 | Ohtani et al. | 430/110 |
| 5,766,814 | 6/1998 | Baba et al. | 430/122 |

FOREIGN PATENT DOCUMENTS 441 127 A1 8/1991 European Pat. Off. .

662 643 A2 7/1995 European Pat. Off. .

OTHER PUBLICATIONS

Database WPI, Week 9410, Derwent Publications Ltd., London, GB; AN 94–077702; AP–JP920202016 (Kyocera Corp) –Abstract.

Patent Abstracts of Japan, vol. 24, No. 231 (P–878), May 29, 1989 & JP 01 040952 A, Feb. 13, 1989 (Fuji Xerox Co., Ltd.).

*Primary Examiner*—John Goodrow
*Attorney, Agent, or Firm*—Oblon, Spivak, McClelland, Maier & Neustadt, P.C.

[57] ABSTRACT

The invention relates to a carrier for electrophotography comprising a carrier core material covered with a polymeric polyolefin-based resin. Such a carrier is used that the carrier core material content accounts for 90% by weight or more of the carrier and he carrier surface has a shape factor S(smoothness) satisfying the relation, $100 \leqq S < 130$, when represented by the following equation (I):

$$S=(L^2/A)\times(1/4\pi)\times 100 \quad \text{(I)},$$

(where L designates an average value of an outer periphery of a projection of the carrier and A designates an average value of a projected area of the carrier). Accordingly, it is possible to provide a carrier covered with a resin which is excellent in durability, spent resistance and the like, effectively prevents change in properties of matter after a long time use, peeling of a covering resin and deposition of the peeled resin to a doctor blade in a developing machine, and does not cause degradation in a quality of copying in the event of continuous copying, and a developing material for electrophotography making use of the carrier.

6 Claims, 2 Drawing Sheets

CARRIER FOR ELECTROPHOTOGRAPHY AND DEVELOPING MATERIAL FOR ELECTROPHOTOGRAPHY USING SAME

TECHNICAL FIELD

The present invention relates to a carrier for electrophotography and to a developer for electrophotography comprising the carrier. More precisely, it relates to a carrier with excellent durability for electrophotography, which is favorably used as one component in two-component developers for electrophotography, and to a developer for electrophotography comprising the carrier.

BACKGROUND ART

A two-component developing method using a mixture of an insulating nonmagnetic toner and magnetic carrier particles has heretofore been known useful for the system of developing electrostatic latent images in electrophotography. In the two-component developing method, the carrier plays the role of frictionally charging the toner and carrying it onto the surface of a photoreceptor on which the charged toner is contacted with electrostatic latent images.

Of the particulate carrier to be used in such two-component development, the magnetic carrier core is generally coated with a suitable resin material for purposes of ensuring the spent resistance of the carrier (for preventing spent toner from filming on the surfaces of carrier particles), making carrier particles have a uniform surface, prolonging the life of developers comprising the carrier, preventing the surface oxidation of the carrier, improving the weather resistance of the carrier, protecting photoreceptors from the carrier in order not to be scratched or worn by the carrier, controlling the resistance of the carrier, controlling the chargeable polarity of the carrier, and controlling the degree of charging of the carrier.

As such coated carriers, for example, known are polyolefinic resin-coated carriers (see, for example, Japanese Patent Application Laid-Open Nos. Sho-52-154639 and Sho-54-35735).

Precisely, Japanese Patent Application Laid-Open No. Sho-52-154639 discloses a polypropylene resin-coated carrier, which is produced by heating and melting a polypropylene resin in a suitable solvent followed by spraying the resin melt onto a carrier core. Japanese Patent Application Laid-Open No. Sho-54-35735 discloses a coated carrier, which is produced by applying a powder of a coating material onto carrier particles followed by heating the coated carrier particles at a temperature not lower than the melting point of the coating material to thereby fix the coat on the carrier particles.

However, those polyolefinic resin-coated carriers are defective in that the adhesion between the coating layer and the carrier core is poor and therefore the durability of the carriers is poor. For example, when the carriers are used in continuous copying operations, the coating layer is often peeled off from the carrier core. In addition, the methods of producing those coated carriers are problematic in that the thickness of the coating layer is difficult to control.

In order to solve those problems, a technique has been proposed of processing the surface of a carrier core with an olefin polymerization catalyst followed by directly polymerizing an olefin on the thus-processed surface of the carrier core to produce a resin-coated carrier. For example, using this technique, produced are polyolefinic resin-coated carriers with good electrostatic characteristics, spend resistance, charge stability and weather resistance, of which the surface of the coating resin has a roughened structure (see, for example, Japanese Patent Application Laid-Open Nos. Hei-2-187770, Hei-2-187771 and Hei-3-208060).

The resin coats of those resin-coated carriers are effective in preventing the change in the physical properties of the carriers themselves during the use of the carriers and also the change in the physical properties of photoreceptors to which developers comprising the carriers are applied. However, the resin-coated carriers, as having such roughened surfaces, are not always satisfactory since their surface conditions often vary, while the carriers are used for a long period of time in developing machines, due to the shear of the carrier particles themselves being stirred and due to the shear of the carrier particles and toner particles being stirred together, and even due to the stress of those particles against doctor blades, resulting in that the carriers could not sufficiently keep their original physical properties such as electric resistance. As a result of long-term use of those resin-coated carriers, the quality of images formed is often worsened.

In addition, the resin-coated carriers are further problematic in that their resin coats are often partly cut off from their surfaces due to the shear of the carrier particles being stirred in developing machines and due to the repeated contact of the carrier particles with doctor blades in developing machines, resulting in that the resin thus cut away from the carrier particles adheres onto the doctor blades. The adhesion of the resin onto the doctor blades often causes insufficient supply of toners to the developing zone in the developing machines, thereby producing other problems in that the density of images formed is lowered, that streaks are formed in the images and that the quality of the images is worsened. For these reasons, the resin-coated carriers are not always satisfactory.

The doctor blade as referred to herein is meant to indicate a metal plate that acts to control the thickness of the carrier layer to be formed on the magnetic sleeve of a developing machine, and generally, it is made of brass, stainless steel or the like.

The present invention has been made in consideration of the above-mentioned problems, and its object is to provide a carrier with good durability for electrophotography, of which the properties do not change in its long-term use so that the images formed using the carrier always have their original quality, and to provide a developer for electrophotography that comprises the carrier.

Specifically, the object of the invention is to provide a resin-coated carrier for electrophotography, of which the resin coat does neither peel off nor adhere onto the doctor blades in developing machines in its long-term use, and which is stably used for a long period of time without worsening the quality of images being formed, and to provide a developer for electrophotography that comprises the carrier.

DISCLOSURE OF THE INVENTION

In order to attain the above-mentioned object, we, the present inventors have assiduously studied, and, as a result, have obtained the following findings and have completed the present invention. Resin-coated carriers generally have different surface conditions, depending on the coating method employed, the thickness of the resin coat formed, and the shape and the surface condition of the carrier core used. The properties of such resin-coated carriers, especially their electric resistance, bulk density and flowability, greatly depend on their surface conditions. Of the conventional resin-coated carriers having roughened surface structures, the roughened surfaces are gradually smoothed or cut away in their long-term use in developing machines, due to the shear of the carrier particles themselves being stirred and due to the shear of the carrier particles and toner particles being stirred together, and even due to the stress of those particles against doctor blades, as so mentioned hereinabove, while their properties, especially their electric resistance greatly vary, resulting in that the density and even the quality of the images formed are lowered. In addition, the peeling of the resin coat from the carriers and the adhesion of the peeled resin to doctor blades also cause the lowering of the quality of the images formed. We, the present inventors have found that, in order to obtain resin-coated carriers of which the properties do not change in their long-term use and which therefore can be used continuously for a long period of time without requiring exchanges, it is desirable to make the original surface condition of the resin-coated carriers as smooth as possible, and that it is desirable to use a high-molecular weight polyolefin-based resin as the coating resin for the carriers. On the basis of these findings, we have completed the present invention.

Specifically, the invention provides a carrier for electrophotography, of which the core is coated with a high-molecular polyolefin-based resin, and which is characterized in that the carrier core content accounts for 90% by weight or more of the carrier and that the carrier surface has a shape factor S (smoothness) satisfying the relation, $100 \leqq S < 130$, when represented by the following equation (I):

$$S=(L^2/A)\times(1/4\pi)\times 100 \quad \text{(I)}$$

wherein L represents an averaged value of the outer periphery of the projected image of each carrier particle, and A represents an averaged value of the projected area of each carrier particle.

One preferred embodiment of the carrier is such that the high-molecular polyolefin-based resin has a number-average molecular weight of 10,000 or more or a weight-average number of 50,000 or more.

Another preferred embodiment of the carrier is such that the high-molecular polyolefin-based resin is formed by directly polymerizing an olefinic monomer on the surface of the carrier core.

Another preferred embodiment of the carrier is such that the high-molecular polyolefin-based resin is a high-molecular polyethylene resin.

Still another preferred embodiment of the carrier is such that the shape factor S (smoothness) of the carrier surface is attained by heating a carrier having a shape factor S of larger than 130 and/or giving a shock thereto.

The invention also provides a carrier for electrophotography, of which the core is coated with a resin, and which is characterized in that the carrier core content accounts for 90% by weight or more of the carrier, that the carrier has a smooth surface and that the change in the resistance of the carrier after its use for 200 hours is not larger than $10^4$.

One preferred embodiment of the carrier is such that its surface has a shape factor S (smoothness) satisfying the relation, $100 \leqq S < 130$, when represented by the following equation (I):

$$S=(L^2/A)\times(1/4\pi)\times 100 \quad \text{(I)}$$

and that the change in the resistance of the carrier after its use for 200 hours is not larger than $10^4$.

The invention further provides a developer for electrophotography, which comprises the carrier and a toner.

BEST MODES OF CARRYING OUT THE INVENTION

Figure 1:
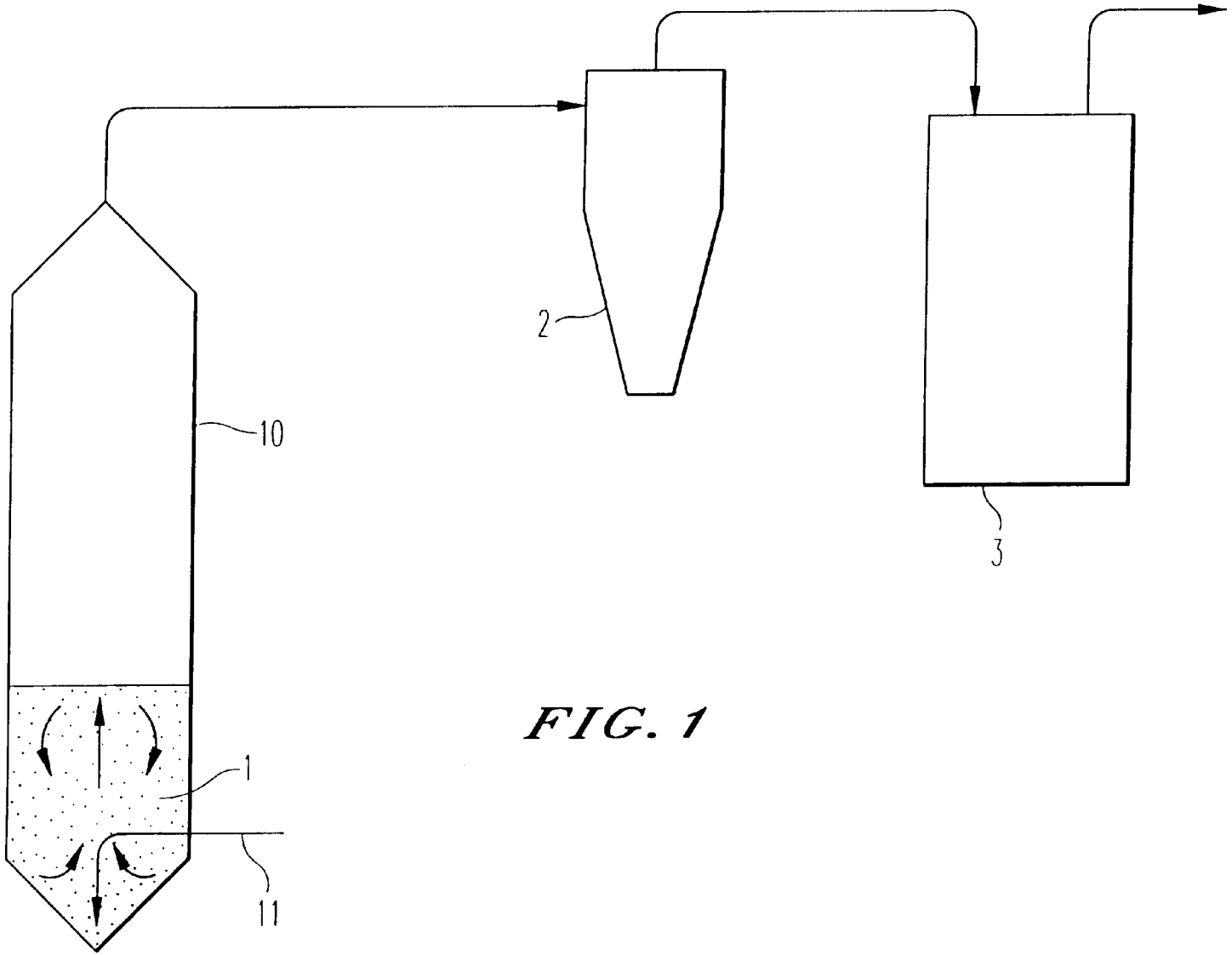
FIG. 1 is an explanatory view showing one example of surface treatment of the carrier for electrophotography of the invention.

Now concretely described hereinunder are embodiments of the carrier for electrophotography of the invention and those of the developer for electrophotography of the invention that comprises the carrier.

I. Carrier for Electrophotography

1. Carrier Core (1) Material

The carrier core for use in the invention is not specifically defined and may be any and every one that is known usable in two-component carriers for electrophotography, including, for example, (1) ferrite and magnetite, and metals such as iron, nickel and cobalt; (2) alloys and mixtures of those metals and other metals such as copper, zinc, antimony, aluminium, lead, tin, bismuth, beryllium, manganese, magnesium, selenium, tungsten, zirconium and vanadium; (3) mixtures of ferrite or the like with metal oxides such as iron oxide, titanium oxide and magnesium oxide, nitrides such as chromium nitride and vanadium nitride, and carbides such as silicon carbide and tungsten carbide; (4) ferromagnetic ferrite, and (5) mixtures of those substances.

(2) Shape, Particle Size

The shape of the carrier core is not specifically defined and may be, for example, spherical or amorphous. The particle size of the carrier core is not also specifically defined, but is preferably between 20 and 100 $\mu$m. If it is smaller than 20 $\mu$m, the carrier will scatter and adhere onto photoreceptors. However, if larger than 100 $\mu$m, the carrier will produce streaks on the images formed, whereby the image quality is worsened.

(3) Content

The carrier core content shall be not smaller than 90% by weight of the carrier, but is preferably not smaller than 95% by weight thereof. This compositional ratio shall indirectly define the thickness of the resin coat of the carrier. If the content is smaller than 90% by weight, the thickness of the resin coat is too large, thereby producing some problems in the actual use of the carrier in developers in that the resin coat layer is peeled off and that the carrier is charged too much. Developers comprising the defective carrier could not have good durability and good charge stability. In addition, the defective carrier is further problematic in that it lowers the reproducibility of fine lines of images to be formed and worsens the quality of images to be formed. The uppermost limit of the carrier core content is not specifically defined and may be such that the surface of the carrier core can be completely covered with the resin coat, or that is, may be about 99.5% by weight. This may vary, depending on the properties of the carrier core and the coating method employed.

2. Coating Resin (1) Kind

The coating resin for use in the invention is not specifically defined and may be any and every resin that is generally used for coating carrier cores, including, for example, various thermoplastic resins such as silicone resins crosslinked through condensation, (meth)acrylic resins, polyolefin-based resins, polyamide-based resins, polyether-based resins, polysulfone-based resins, polyester-based resins, polybutyral-based resins, urethane/urea-based resins, teflon-based resins and their mixtures, and also random copolymers, block copolymers and graft copolymers of those resins. In order to improve its chargeability, the carrier may be additionally coated with other various resins having polar groups. In order to further improve its chargeability and other characteristics helpful in improving the developability of developers comprising the carrier, the carrier may be additionally coated with other various organic and/or inorganic substances, and/or such additional organic and/or inorganic substances may be dispersed in the coating resin. As the case may be, those additional resins and substances may be fixed onto the surface of the carrier.

Of those resins, preferred are high-molecular weight polyolefin-based resins as having good spent resistance. The high-molecular polyolefin-based resins include, for example, homopolymers of α-olefins such as ethylene, propylene, 1-butene and 4-methylpentene-1; copolymers of those α-olefins and other α-olefins such as 1-hexene and 1-octene; and their mixtures. Of those, preferred are ethylene-based, high-molecular polyethylenes as having high abrasion resistance. Especially preferred are high-molecular polyethylenes having a number-average molecular weight of 10,000 or more or a weight-average molecular weight of 50,000 or more. The uppermost limit of the number-average molecular weight of those polymers and that of the weight-average molecular weight thereof are not specifically defined. Polyethylenes having a number-average molecular weight of up to about 200,000 or a weight-average molecular weight of up to about 2,000,000 could satisfactorily attain the object of the invention. However, if polyethylenes having a molecular weight higher than that are used to treat the surface of a carrier having a shape factor S of larger than 130 with heating the carrier and/or giving a shock thereto, there is a probability that the intended carrier having a surface smoothness of $100 \leqq S < 130$ could not be obtained.

In general, polyethylenes having a number-average molecular weight of smaller than 10,000, for example, polyethylene waxes (e.g., Mitsui Hi-Wax, manufactured by Mitsui Petrochemical Co.; Dialene 30, manufactured by Mitsubishi Chemical Co.; Nisseki Lexpole, manufactured by Nippon Petroleum Co.; Sun-Wax, manufactured by Sanyo Chemical Co.; Polylets, manufactured by Neutral Wax Polymer Co.; Neo-Wax, manufactured by Yasuhara Chemical Co.; AC Polyethylene, manufactured by Allied Chemical Co.; Epolene, manufactured by Eastman Kodak Co.; Hoechst Wax, manufactured by Hoechst Co.; A-Wax, manufactured by BASF Co.; Poly-Wax, manufactured by Petrolite Co.; Escomer, manufactured by Exxon Chemical Co.) are differentiated from the high-molecular weight polyethylenes to be used in the invention. Such polyethylene waxes can be dissolved in hot toluene or the like, and the resulting solutions can be applied to carrier cores to in ordinary dipping or spraying methods. However, since the resin coats of those polymers have low mechanical strength and poor abrasion resistance, they are peeled off from the cores due to the shear occurring in developing machines, while used for a long period of time.

The thickness of the resin coat is preferably between 0.1 and 5.0 μm. If it is larger than 5.0 μm, the above-mentioned problems will unfavorably occur. If it is smaller than 0.1 μm, another problem will unfavorably occur in that toner adheres onto the partly-exposed carrier cores.

(2) Surface Smoothness

As has been mentioned hereinabove, in order to obtain resin-coated carriers of which the properties do not change in their long-term use and which therefore can be used continuously for a long period of time without requiring exchanges, and in order to obtain resin-coated carriers from which the coating resin does not peel off in their long-term use and which therefore do not cause the adhesion of resin onto doctor blades in developing machines, it is desirable to make the original surface condition of the resin-coated carriers as smooth as possible.

It is difficult to quantitatively define the smooth condition (smoothness) of the surfaces of resin-coated carriers. However, the surface smoothness could be defined on the basis of the shape factor S to be represented by the above-mentioned equation (I):

$$S=(L^2/A)\times(1/4\pi)\times 100 \quad \text{(I)}$$

wherein L represents an averaged value of the outer periphery of the projected image of each carrier particle, and A represents an averaged value of the projected area of each carrier particle.

The resin-coated carrier of the invention preferably has a value of the shape factor S that satisfies the relation, $100 \leqq S < 130$, more preferably $100 \leqq S \leqq 120$. The shape factor indicates the degree of roughness of the surface of each carrier particle. Carrier particles having a larger degree of surface roughness have a value of S remoter from 100. The surface roughness of carrier particles having a value of S larger than 130 reduces due to the shear occurring in their use, resulting in that the properties of the carrier particles being used vary. If those carrier particles are used for development, it is difficult to obtain images always having their original image quality.

The shape factor S is a value to be obtained by dividing the square of the average of the outer periphery of the projected image of each carrier particle, which is formed through parallel rays, by the average of the projected area of each carrier particle and by 4 π, followed by multiplying the resulting quotient by 100. In the invention, the shape factor S (smoothness) is obtained in that manner. In Examples mentioned hereinunder, the electromicroscopic image (SEM image) of each carrier sample was analyzed, using an image analyzing system (manufactured by Stanley Electric Co.), to obtain the shape factor S of the sample. In general, there is not any significant difference in the shape factor S which is obtained in the same measurement principle, even though the system used for the measurement varies. Therefore, so far as the measurement principle mentioned hereinabove is employed for the measurement of the shape factor S, the system to be used for the measurement is not limited to only that employed in the following Examples.

3. Properties (1) Resistance Change

As has been mentioned hereinabove, the change in electric resistance of carriers in their long-term use has influences on the density and the quality of images formed. Therefore, the change in electric resistance of carriers after their use for 200 hours is preferably not larger than $10^4$, more preferably not larger than $10^3$, even more preferably not larger than $10^2$. If the resistance change is larger than $10^4$, it will unfavorably result in the lowering of the image density and the image quality.

The resistance change ΔR is represented by the following equation:

$$\Delta R = (\text{resistance value after use for 200 hours})/(\text{initial resistance value})$$

(2) Electroconductive Characteristic

Regarding the electroconductive characteristic of the carrier, its optimum value may vary, depending on the system of the developer comprising the carrier. In general, however, it is desirable that the carrier has a resistance value of between $10^2$ and $10^{14}$ (Ω·cm) when measured according to the above-mentioned method.

If its resistance value is smaller than $10^2$ Ω·cm, carrier development(imaged with toner and carrier) will occur. If, on the other hand, it is larger than $10^{14}$ Ω·cm, the carrier causes the lowering of the image density and the worsening of the image quality.

4. Production Method (1) Resin Coating Method

The method for producing the carrier of the invention, or that is, the resin coating method for the carrier is not specifically defined, and any and every known method is employable, including, for example, a dipping method, a fluidized bed method, a dry coating method, a dry spraying method, and a polymerization method. For the coating with polyolefin-based resins including polyethylene resins, preferred is a polymerization method as producing a strong and hardly-peeling resin coat on the surface of the carrier.

(2) Polymerization Method

The polymerization method as referred to herein is to directly polymerize an olefin on the surface of a carrier core to produce a polyolefin resin-coated carrier, by first processing the surface of the carrier core with an olefin polymerization catalyst including an ethylene polymerization catalyst and then applying an olefin monomer onto the thus processed carrier core. For this, for example, referred to is the method described in Japanese Patent Application Laid-Open No. Hei-2-187770. Briefly, a carrier core is first catalytically processed with a high-activity catalyst component for ethylene polymerization, which contains a titanium compound and/or a zirconium compound and which is soluble in hydrocarbon solvents (e.g., hexane, heptane), then the resulting product is suspended in a hydrocarbon solvent such as that mentioned above along with an organic aluminium compound, and an ethylene monomer is added to the resulting suspension and is polymerized on the surface of the carrier core to form a resin coat layer on the carrier core.

In this method, the polyethylene coat layer is directly formed on the surface of the carrier core, and the coat therefore has high strength and good durability.

Where the carrier is desired to contain fine particles having a charging function or fine electroconductive particles, the particles may be added to the carrier while the polyethylene coat layer is formed.

(3) Surface Treatment

The most characteristic feature of the carrier of the invention is that the surface of the resin coat of the carrier is smooth, or that is, it has a shape factor S falling within the range of $100 \leqq S < 130$. Depending on the coating method and on the shape and the surface condition of the carrier core, the surface of the resin-coated carrier may have a shape factor S of 130 or larger. If so, the resin-coated carrier may be further surface-treated to make it have a desired surface condition. The surface-treatment for this purpose is not specifically defined. For example, the coated carrier may be suitably heated and/or a suitable shock may be given thereto to thereby control its surface condition. For this, for example, employable are the following methods.

① Method of instantaneously heating the coated carrier: The resin-coated carrier is instantaneously heated to melt its resin coat, whereby its surface is smoothed. For this, concretely, employable is any of a thermal rounding machine (for example, manufactured by Hosokawa Micron Co.) in which the resin-coated carrier is instantaneously brought into contact with hot air in a heating device to heat the resin coat at a temperature not lower than its melting point, thereby smoothing the surface of the carrier; or an aerating drier in which the resin-coated carrier is put into hot airflow and moved with the hot airflow while instantaneously heating the resin coat at a temperature not lower than its melting point, thereby smoothing the surface of the carrier. In these devices, the inner temperature is settled to be not lower than the melting point of the resin coat but lower its decomposing point, at which the resin-coated carrier is instantaneously heated therein. The instantaneous heating as referred to herein is meant to indicate the heating time within which the carrier particles do not aggregate together. Preferably, the instantaneous heating time is 1 or 2 seconds or so. If desired, the thus heat-treated carrier may be gradually cooled.

② Method of giving a shock to the resin-coated carrier: The resin-coated carrier particles are made to collide with each other to thereby give a shock to those carriers, whereby the resin coat is smoothed to make the resin-coated carrier have a smooth surface. The means of giving a shock to the carrier is not specifically defined. For example, employable is any of a method of fluidizing the carrier particles in airflow to thereby make the particles collide with each other; a method of rotating and/or shaking a container containing the carrier particles to thereby fluidize the particles and make then collide with each other; and a method of stirring the carrier particles with paddles or rotating blades to thereby make the particles collide with each other.

Various devices are usable for those shock-giving methods, including, for example, Spiracoater (manufactured by Okada Seiko Co.) in which carrier particles are fluidized with airflow and made to colloid with each other; Aggromaster (manufactured by Hosokawa Micron Co.); Fluidized Bed Drier (manufactured by Nara Machine Manufacturing Co.); a fluidized bed airflow classifier; V Drier (manufactured by Chuo Chemical Engineering Co.) and a rotary mill, in which carrier particles are fluidized in a container by rotating and shaking the container to thereby make the particles collide with each other; Solid Air (manufactured by Hosokawa Micron Co.) in which carrier particles are stirred with paddles or rotating blades and made to collide with each other; Henschel Mixer (manufactured by Mitsui Miike Chemical Engineering Co.); Universal Mixer (manufactured by Dalton Co.); Paddle Drier (manufactured by Nara Machine Manufacturing Co.).

Of those, especially effective is a fluidized bed airflow classifier, in which impurities can be removed while the particles are surface-treated. By increasing the linear velocity of the carrier particles being processed in the fluidized bed steam classifier, the processing time may be shortened. In those points, the fluidized bed airflow classifier is advantageous. On the other hand, the increase in the linear velocity will lower the yield. To evade this disadvantage, for example, the diameter of the upper tube of the fluidized bed airflow classifier is enlarged, whereby the processing time can be shortened with preventing the decrease in the yield.

The shock may be given to the carrier particles under heat, whereby the processing time may be shortened. For this, the inner temperature in the device is settled to be somewhat lower than the melting point of the resin coat, for example, by from 5 to 10° C. If the inner temperature is too much lower than the melting point of the resin coat, the heating effect could not be obtained and the processing time could not be shortened. However, if it is not lower than the melting point of the resin coat, the carrier particles will aggregate together.

II. Developer for Electrophotography

The developer for electrophotography of the invention is produced by mixing the carrier with various toners.

1. Toner

Employable herein are any toners produced by any known methods, including, for example, those produced by a suspension polymerization method, a grinding method, a microcapsulating method, a spray-drying method, and a mechanochemical method. At least a binder resin, a colorant and optionally other additives, such as a charge controlling agent, a lubricant, an offset inhibitor and a fixation improver are added to the toners. If desired, a magnetic material may be added thereto to obtain magnetic toners, which may have improved developability and may be prevented from scattering in developing machines. In order to improve the flowability of the toners, a fluidizing agent may be added to developing machines separately from the toners. As the binder resin, for example, employable is any of polystyrene-based resins such as polystyrene, styrene-butadiene copolymer and styrene-acrylic copolymer; ethylene-based copolymers such as polyethylene, ethylene-vinyl acetate copolymer and ethylene-vinyl alcohol copolymer; and epoxy-based resins, phenol-based resins, acryl phthalate resins, polyamide resins, polyester-based resins, and maleic acid resins. As the colorant, usable are any known dyes and pigments including, for example, carbon black, phthalocyanine blue, indanthrene blue, peacock blue, permanent red, red iron oxide, alizarin lake, chrome green, malachite green lake, methyl violet lake, hansa yellow, permanent yellow, and titanium oxide. As the charge controlling agent, usable are positive charge controlling agents such as nigrosine, nigrosine base, triphenylmethane-based compounds, polyvinyl pyridine, and quaternary ammonium salts; and negative charge controlling agents such as metal complexes of alkyl-substituted salicylic acids (e.g., chromium complexes or zinc complexes of di-tert-butylsalicylic acid). As the lubricant, usable are teflon, zinc stearate, and polyvinylidene fluoride. As the offset inhibitor and the fixation improver, usable are polyolefin waxes such as low-molecular polypropylene and its modified derivatives. As the magnetic material, usable are magnetite, ferrite, iron, and nickel. As the fluidizing agent, usable are silica, titanium oxide, and aluminium oxide.

Preferably, the toner has a mean particle size of not larger than 20 $\mu$m, more preferably from 5 $\mu$m to 15 $\mu$m.

2. Mixing Ratio

The mixing ratio of the toner to the carrier may be such that the toner content is from 2 to 20% by weight, preferably from 3 to 15% by weight, more preferably from 4 to 12% by weight. If the mixing ratio of the toner is smaller than 2% by weight, the toner will be charged too much, resulting in that it could not produce images with good density. However, if larger than 20% by weight, the toner could not be charged well so that it scatters out from the developing zone to stain copying machines and produce toner fog on the images formed.

3. Use

The developer of the invention can be used in electrophotographic systems for 2-component or 1.5-component development, for example, in copying machines (e.g., analog, digital, monochromatic or color copying machines), printers and facsimiles. In particular, it is most suitably used in high-speed or ultra-high-speed copying machines and printers in which great stress is imparted to the developer in their developing zone. For the developer, the imaging system, the exposure system, the development system (device) and other various control systems (e.g., the toner concentration control system in developing devices) are not specifically defined. Depending on various types of those systems, the carrier and the toner may be so controlled that their resistance, particle size, particle size distribution, magnetic force and charging could be optimum ones.

Now, the invention is described more concretely hereinunder with reference to the following Examples.

The measurement of the shape factor (S) of the carriers obtained in Examples 1 to 9 and Comparative Examples 1 to 8, the measurement of the electric resistance of the carriers obtained in Examples 1 to 6 and Comparative Examples 1 to 5, the durability test (for image evaluation) for the carriers obtained in Examples 1 to 6 and Comparative Examples 1 to 5, and the durability test (for peeling resistance of resin coat) for the carriers obtained in Examples 7 to 8 and Comparative Examples 6 to 8 were effected according to the methods mentioned below.

[Measurement of Shape Factor (S)]

As has been mentioned hereinabove, the image (SEM image) of each carrier sample as taken through scanning electronic microscopy was inputted into an image analyzing system (manufactured by Stanley Electric Co.), in which the outer periphery of the projected image of each carrier particle and the projected area of each carrier particle were measured.

[Measurement of Electric Resistance]

Carrier particles were put into a container having a bottom area (electrode area) of 5 $cm^2$ to form therein a carrier layer of 0.5 cm thick, and a load of 1 kg was applied to the carrier layer while a voltage of from 1 to 500 V was applied to the surface of the carrier layer, whereupon the current running through the bottom of the container is measured. From the thus-measured data, obtained was the electric resistance of the carrier sample.

[Durability Test (for image evaluation)]

Machine Used for the Test

A commercially-available, middle-speed copying machine (Duplicator Model 5039, manufactured by Fuji Xerox Co.) (copying speed: 40 A4 sheets/min) was so modified that its developer stirring part and its magnetic brush forming part could operate independently in order that its developing machine part could be run by itself. The thus-modified developing machine was used in this test.

Evaluation

① Into this machine (developing machine) was put a predetermined amount of a developer, which had been prepared by blending a carrier obtained in any of Examples 1 to 6 and Comparative Examples 1 to 5 with a commercially-available, polyester-based toner in a ratio, carrier/toner, of 100/5 (by weight). Using test charts, the initial images formed were evaluated with respect to the density of the solid part and to the half-tone reproducibility.

The test charts used herein were 1R and 2R issued by the Electrophotographic Society of Japan.

② Next, the developing machine was continuously idled by itself for 200 hours, and the image formed in the machine was evaluated in the same manner as above.

③ After this, the developer was taken out from the developing machine, and the toner as electrostatically adhered to the carrier was blown off from the carrier, using stainless steel gauze of which the mesh is smaller than the particle size of the carrier. The electric resistance of the resulting carrier was measured.

Measurement of Image Density of Solid Part

Using a reflection densitometer (RD 917, manufactured by Sakata Inks Co.), the image density of each of three solid parts was measured, and the data were averaged.

Initial Half-tone Reproducibility

The image density of the 8-stage gray scale of the test chart 2R was measured, using the same reflection densitometer as above, and the half-tone reproducibility was evaluated for clear differentiation of the 8-stage gray scale in accordance with the following criteria.

A: The 8-stage gray scale was clearly differentiated.

B: In one or two points, the density difference between the adjacent stages could not be differentiated from each other.

C: In three or more points, the density difference between the adjacent stages could not be differentiated from each other.

Half-tone Reproducibility after idling for 200 hours

The image density of the middle part (the 4th part from the right) of the 8-stage gray scale of the test chart 2R was measured, using the same reflection densitometer as above, and the difference between the initial image density and the image density obtained after idling for 200 hours was determined, from which was obtained the half-tone reproducibility after idling for 200 hours in accordance with the following criteria.

A: The difference in the image density was below ±10%.

B: The difference in the image density was from ±10% to +/−20%.

C: The difference in the image density was above ±20%.

Of those ranks, the samples of A and B are within the acceptable range, while those of C failed in the durability test and did not satisfy the object of the invention.

[Durability Test (for peeling resistance of resin coat)]

Machine Used for the Test

The same machine as that used for the image evaluated was used for this test.

Evaluation

A predetermined amount of a carrier sample obtained in any of Examples 7 to 9 and Comparative Examples 6 to 8 was put into the machine (developing machine), which was run for 50 hours. Then, the doctor blade was taken out from the machine, and checked as to whether or not it had any deposit thereon. In addition, the carrier was taken out from the machine, and its electromicroscopic image was checked as to whether or not the resin coat was peeled off from the carrier particles. The peeling of resin coat as referred to herein is meant to indicate that the resin coat was dropped or worn whereby the core was exposed. The sample of which the core was exposed in that manner was referred to as a peeled sample.

EXAMPLE 1

Production of Carrier (1) Preparation of Titanium-containing Catalyst Component 200 ml of n-heptane that had been dewatered at room temperature, and 15 g (25 mmols) of magnesium stearate that had been dewatered at 120° C. under a reduced pressure of 2 mmHg were formed into a slurry in a 500-ml flask as purged with argon. To this was dropwise added 0.44 g (2.3 mmols) of titanium tetrachloride with stirring, then heated and reacted for 1 hour under reflux to obtain a viscous transparent liquid of a titanium-containing catalyst (active catalyst).

(2) Determination of Activity of Titanium-containing Catalyst Component:

400 ml of dewatered hexane, 0.8 mmols of triethylaluminium, 0.8 mmols of diethylaluminium chloride, and 0.004 mmols, in terms of the titanium atom, of the titanium-containing catalyst obtained in (1) were put into a one-liter autoclave as purged with argon, and then heated up to 90° C. In this step, the inner pressure in the autoclave was 1.5 kg/cm$^2$G. Next, hydrogen was introduced into the autoclave to be at 5.5 kg/cm$^2$G, and thereafter ethylene was continuously fed thereinto so that the total pressure in the autoclave might be kept at 9.5 kg/cm$^2$G, and polymerized for 1 hour to obtain 70 g of a polymer. The polymerization activity of the catalyst was 365 kg/g of Ti/hr, and the MFR (melt flow rate at 190° C. under a load of 2.16 kg, as measured according to JIS K 7210) of the polymer obtained herein was 40.

(3) Production of Polyethylene-coated Carrier 960 g of a powder of sintered ferrite, F-300 (manufactured by Powdertec Co., having a mean particle size of 50 $\mu$m) was put into a 2-liter autoclave as purged with argon, then heated up to 80° C. and dried under a reduced pressure of 10 mmHg for 1 hour. Next, this was cooled to 40° C., and 800 ml of dewatered hexane was added thereto and stirred. Next, 5.0 mmols of diethylaluminium chloride and 0.05 mmols, in terms of the titanium atom, of the titanium-containing catalyst component obtained in (1) were added thereto, and reacted for 30 minutes. Next, this was heated up to 90° C., and 4 kg of ethylene was introduced thereinto. In this step, the inner pressure in the autoclave was 3.0 kg/cm$^2$G. Next, hydrogen was introduced into the autoclave to be at 3.2 kg/cm$^2$G, and thereafter 5.0 mmols of triethylaluminium was added thereto, and the polymerization of the monomer was started. After about 5 minutes, the inner pressure was lowered to 2.3 kg/cm$^2$G and stabilized. Next, a slurry of 5.5 g of carbon black (MA-100, manufactured by Mitsubishi Chemical Co.) in 100 ml of dewatered hexane was added thereto, and ethylene was continuously fed thereinto so that the inner pressure in the autoclave might be kept at 4.3 kg/cm$^2$G, and polymerized for 45 minutes. After 40 g of ethylene in total was introduced into the autoclave, the introduction of ethylene was stopped. Thus was obtained 1005.5 g in total of a carbon black-containing polyethylene resin-coated ferrite. This was dried in powder, which was evenly black. Observing this powder with an electronic microscope, it was found that the ferrite surface was coated with a thin film of polyethylene, in which carbon black was uniformly dispersed. Using TGA (thermobalance), this composition was analyzed to have a compositional ratio of ferrite/carbon black/polyethylene of 95.5/0.5/4.0 by weight.

The carrier thus obtained in this intermediate stage is referred to as carrier A1. The shape factor S of the carrier A1 was 148, and its electric resistance was 1.8E+08 [Ω·cm]. The number-average molecular weight of the coating polyethylene was 11,000, and its weight-average molecular weight was 206,000.

The molecular weight of the coating polyethylene was measured as follows: The resin coat of the resin-coated carrier was dissolved in TCB (trichlorobenzene, solvent), and the core was removed through filtration using a glass filter. The molecular weight of the thus-dissolved resin was measured, using Waters' ALC/GPC in which was used a solvent of TCB at 135° C. The columns used herein were TSK HM+GMH6×2, at 150° C.

Next, the carrier A1 was classified through a 125 $\mu$m sieve, through which large particles of not smaller than 125 $\mu$m in size were removed. The thus-classified carrier 1 was put into a fluidized bed airflow classifier 10 having a column diameter of 14 cm, as in FIG. 1, and classified therein for 1 hour with airflow 11 which was introduced into the classifier at a linear airflow rate of 10 cm/sec, whereby the resin pieces not containing the carrier core were removed. The resin pieces not containing the carrier core were introduced into a cyclone 2 through the top of the classifier, in which relatively heavy resin pieces were removed. The remaining, relatively light resin pieces were then introduced into a bag filter 3 through the top of the cyclone 2, in which the relatively light resin pieces were caught and only airflow was discharged into air.

Next, this carrier was taken out from the classifier, and then surface-treated in a thermal rounding machine (manufactured by Hosokawa Micron Co.) while being heated at 200° C. for 1 second. Next, the thus surface-treated carrier was classified through a 125 μm sieve to remove the aggregates. The carrier thus obtained is referred to as carrier A2. The observation of the carrier A2 with an electronic microscope revealed little roughness of its surface. The S value of the thus-processed carrier was 105, and its electric resistance was 9.8E+05 [Ω·cm].

Durability Test (for image evaluation)

Next, the carrier A2 was blended with a polyester-based toner which had been prepared in Toner Production Example mentioned below, in a ratio, carrier/toner, of 100/5 by weight, to obtain a developer. This was subjected to the durability test (for image evaluation). The data obtained are shown in Table 1.

Toner Production Example

| Components | Amount (wt. pts.) |
|---|---|
| Polyester Resin (R-6361, manufactured by Kao Corp.) | 100 |
| Carbon Black (MA-100, manufactured by Mitsubishi Chemical Co.) | 5 |
| Nigrosine Dye (Bontron N-01, manufactured by Orient Chemical Industry Co.) | 3 |

The above-mentioned components were well milled in a ball mill, and then kneaded in a three-roll kneader heated at 140° C. The resulting blend was spontaneously cooled, then roughly ground in a feather mill and thereafter finely powdered in a jet mill. Next, this was subjected to air classification to obtain a fine powder having a mean particle size of 13 μm.

EXAMPLE 2

Production of Carrier

The carrier A1 was classified through a 125 μm sieve, through which large particles of not smaller than 125 μm in size were removed. The thus-classified carrier was further classified for 1 hour, using the same fluidized bed airflow classifier as in Example 1, at a linear airflow rate of 10 cm/sec, whereby the resin pieces not containing the carrier core were removed. Next, this carrier was taken out from the classifier, and then surface-treated, using a "Solid Air" manufactured by Hosokawa Micron Co., while being heated at 115° C. for 30 minutes. Next, the thus surface-treated carrier was classified through a 125 μm sieve to remove the aggregates. The carrier thus obtained is referred to as carrier B2. The observation of the carrier B2 with an electronic microscope revealed little roughness of its surface. The S value of the thus-processed carrier B2 was 112, and its electric resistance was 1.2E+06 [Ω·cm].

Durability Test (for image evaluation)

The carrier B2 was subjected to the same durability test (for image evaluation) as in Example 1. The data obtained are shown in Table 1.

EXAMPLE 3

Production of Carrier

The carrier A1 was classified through a 125 μm sieve, through which large particles of not smaller than 125 μm in size were removed. The thus-classified carrier was further classified for 1 hour, using the same fluidized bed airflow classifier as in Example 1, at a linear airflow rate of 10 cm/sec, whereby the resin pieces not containing the carrier core were removed. Next, this carrier was taken out from the classifier, and then surface-treated in a rotary mill. The rotary mill contained no grinding media such as balls but contained only the carrier, and was rotated. The thus surface-treated carrier is referred to as carrier C2. The observation of the carrier C2 with an electronic microscope revealed little roughness of its surface. The S value of the thus-processed carrier C2 was 128, and its electric resistance was 7.8E+06 [Ω·cm].

Durability Test (for image evaluation)

The carrier C2 was subjected to the same durability test (for image evaluation) as in Example 1. The data obtained are shown in Table 1.

EXAMPLE 4

Production of Carrier

The carrier A1 was classified through a 125 μm sieve, through which large particles of not smaller than 125 μm in size were removed. The thus-classified carrier was further classified for 1 hour, using the same fluidized bed airflow classifier as in Example 1, at a linear airflow rate of 10 cm/sec, whereby the resin pieces not containing the carrier core were removed.

Next, still in the fluidized bed airflow classifier, this carrier was surface-treated for 50 hours at a linear airflow rate of 20 cm/sec. Through this surface treatment, small particles that are unsuitable for the carrier and the resin pieces with no carrier core which had been newly formed in this surface treatment were introduced into the cyclone 2 through the top of the classifier. In the cyclone 2, relatively heavy particles such as small particles were removed, while the remaining particles were then introduced into the bag filter 3 and removed. After the classifier was stopped, the surface-treated carrier was taken out through the bottom of the classifier. The carrier thus obtained is referred to as carrier D2. The observation of the carrier D2 with an electronic microscope revealed little roughness of its surface. The S value of the thus-processed carrier D2 was 115, and its electric resistance was 5.2E+06 [Ω·cm].

Durability Test (for image evaluation)

The carrier D2 was subjected to the same durability test (for image evaluation) as in Example 1. The data obtained are shown in Table 1.

EXAMPLE 5

Production of Carrier

The carrier A1 was classified through a 125 μm sieve, through which large particles of not smaller than 125 μm in size were removed. The thus-classified carrier was further classified for 1 hour, using the same fluidized bed airflow classifier as in Example 1, at a linear airflow rate of 10 cm/sec, whereby the resin pieces not containing the carrier core were removed. Next, this carrier was taken out from the classifier, and then surface-treated, using an "Aggromaster" manufactured by Hosokawa Micron Co., while being heated at 115° C. for 45 minutes. Next, the thus surface-treated carrier was classified through a 125 μm sieve to remove the aggregates. The carrier thus obtained is referred to as carrier E2. The observation of the carrier E2 with an electronic microscope revealed little roughness of its surface. The S value of the thus-processed carrier E2 was 128, and its electric resistance was 3.3E+06 [Ω·cm].

Durability Test (for image evaluation)

The carrier E2 was subjected to the same durability test (for image evaluation) as in Example 1. The data obtained are shown in Table 1.

EXAMPLE 6

Production of Carrier

The carrier A1 was classified through a 125 μm sieve, through which large particles of not smaller than 125 μm in size were removed. The thus-classified carrier was further classified for 1 hour, using the same fluidized bed airflow classifier as in Example 1, at a linear airflow rate of 10 cm/sec, whereby the resin pieces not containing the carrier core were removed. Next, this carrier was taken out from the classifier, and then surface-treated, using a Henschel mixer manufactured by Mitsui-Miike Chemical Engineering Co., while being heated at 80° C. for 30 minutes. Next, this was classified through a 125 μm sieve to remove the aggregates. The carrier thus obtained is referred to as carrier F2. The observation of the carrier F2 with an electronic microscope revealed little roughness of its surface. The S value of the thus-processed carrier F2 was 108, and its electric resistance was 1.1E+07 [Ω·cm].

Durability Test (for image evaluation)

The carrier F2 was subjected to the same durability test (for image evaluation) as in Example 1. The data obtained are shown in Table 1.

COMPARATIVE EXAMPLE 1

The carrier A1 was subjected to the same durability test (for image evaluation) as in Example 1. The data obtained are shown in Table 1.

COMPARATIVE EXAMPLE 2

Production of Carrier

The carrier A1 was classified through a 125 μm sieve, through which large particles of not smaller than 125 μm in size were removed. The thus-classified carrier was further classified for 1 hour, using the same fluidized bed airflow classifier as in Example 1, at a linear airflow rate of 10 cm/sec, whereby the resin pieces not containing the carrier core were removed. Next, this carrier was taken out from the classifier, and then surface-treated, using a "Solid Air" manufactured by Hosokawa Micron Co., while being heated at 90° C. for 30 minutes. The carrier thus obtained is referred to as carrier G2. The observation of the carrier G2 with an electronic microscope revealed little change in its surface roughness. The S value of the thus-processed carrier G2 was 136, and its electric resistance was 2.0E+07 [Ω·cm].

Durability Test (for image evaluation)

The carrier G2 was subjected to the same durability test (for image evaluation) as in Example 1. The data obtained are shown in Table 1.

COMPARATIVE EXAMPLE 3

Production of Carrier

The carrier A1 was classified through a 125 μm sieve, through which large particles of not smaller than 125 μm in size were removed. The thus-classified carrier was further classified for 1 hour, using the same fluidized bed airflow classifier as in Example 1, at a linear airflow rate of 10 cm/sec, whereby the resin pieces not containing the carrier core were removed. Next, still in the classifier, this carrier was surface-treated for 1 hour at a linear airflow rate of 20 cm/sec in the same manner as in Example 4. The carrier thus obtained is referred to as carrier H2. The observation of the carrier H2 with an electronic microscope revealed little change in its surface roughness. The S value of the thus-processed carrier H2 was 142, and its electric resistance was 1.3E+07 [Ω·cm].

Durability Test (for image evaluation)

The carrier H2 was subjected to the same durability test (for image evaluation) as in Example 1. The data obtained are shown in Table 1.

COMPARATIVE EXAMPLE 4

Production of Carrier

A carrier was produced in the same manner as in the production of the carrier A1 in Example 1, except that the amount of carbon black (MA-100, manufactured by Mitsubishi Chemical Co.) added was changed to 8.2 g. Using TGA (thermobalance), this was analyzed to have a compositional ratio of ferrite/carbon black/polyethylene of 95.2/0.8/4.0 by weight. The carrier thus obtained is referred to as carrier I1. The shape factor S of the carrier I1 was 157, and its electric resistance was 4.2E+06 [Ω·cm].

Durability Test (for image evaluation)

The carrier I1 was subjected to the same durability test (for image evaluation) as in Example 1. The data obtained are shown in Table 1.

COMPARATIVE EXAMPLE 5

Production of Carrier

The carrier I1 was classified through a 125 μm sieve, through which large particles of not smaller than 125 μm in size were removed. The thus-classified carrier was further classified for 1 hour, using the same fluidized bed airflow classifier as in Example 1, at a linear airflow rate of 10 cm/sec, whereby the resin pieces not containing the carrier core were removed. Next, still in the classifier, this carrier was surface-treated for 1 hour at a linear airflow rate of 20 cm/sec in the same manner as in Example 4. The carrier thus obtained is referred to as carrier I2. The observation of the carrier I2 with an electronic microscope revealed little change in its surface roughness. The S value of the thus-processed carrier I2 was 151, and its electric resistance was 6.5E+05 [Ω·cm].

Durability Test (for image evaluation)

The carrier I2 was subjected to the same durability test (for image evaluation) as in Example 1. The data obtained are shown in Table 1.

TABLE 1

| | Carrier | S Value | Initial Electric Resistance [Ω · cm] | Electric Resistance after 200 hours [Ω · cm] | Resistance Change [–] | Initial Image Density | Image Density after 200 hours | Initial Half-tone Repro-ducibility | Half-tone Repro-ducibility after 200 hours |
|---|---|---|---|---|---|---|---|---|---|
| Example 1 | A2 | 105 | 9.8E+05 | 2.0E+06 | 2.0 | 1.45 | 1.42 | A | A |
| Example 2 | B2 | 112 | 1.2E+06 | 4.1E+06 | 3.4 | 1.45 | 1.42 | A | A |
| Example 3 | C2 | 128 | 7.8E+06 | 9.0E+08 | 1.2E+2 | 1.44 | 1.41 | A | A |
| Example 4 | D2 | 115 | 5.2E+06 | 8.3E+08 | 1.6E+2 | 1.44 | 1.41 | A | A |
| Example 5 | E2 | 128 | 3.3E+06 | 4.7E+09 | 1.4E+3 | 1.44 | 1.41 | A | B |
| Example 6 | F2 | 108 | 1.1E+07 | 2.8E+07 | 2.5 | 1.45 | 1.42 | A | A |
| Comparative Example 1 | A1 | 148 | 1.8E+08 | 1.2E+13 | 6.7E+4 | 1.42 | 1.25 | A | C |
| Comparative Example 2 | G2 | 136 | 2.0E+07 | 5.5E+11 | 2.8E+4 | 1.43 | 1.30 | A | C |
| Comparative Example 3 | H2 | 142 | 1.3E+07 | 9.1E+11 | 7.0E+4 | 1.44 | 1.25 | A | C |
| Comparative Example 4 | I1 | 157 | 4.2E+06 | 3.3E+12 | 7.9E+5 | 1.43 | 1.28 | A | C |
| Comparative Example 5 | I2 | 151 | 6.5E+05 | 9.2E+11 | 1.4E+5 | 1.44 | 1.30 | A | C |

As in Table 1, where the carriers of which the S value is larger than 130 (Comparative Examples 1 to 5) were used in image formation, there was a great difference between the original image density and the image density after 200 hours and, in addition, the half-tone reproducibility after 200 hours was poor even though the original half-tone reproducibility was good. As opposed to those, the carriers obtained in Examples of the invention produced no such changes, and were found to have good durability.

Also as in Table 1, the image formation using the carriers with a resistance change of larger than $10^4$ (Comparative Examples 1 to 5) resulted in a great difference between the original image density and the image density after 200 hours and, in addition, resulted in that the half-tone reproducibility after 200 hours was poor even though the original half-tone reproducibility was good. As opposed to those comparative carriers, the resistance change of the carriers obtained in Examples of the invention was at most about $10^3$, which verified the high durability of the carriers of the invention in image formation.

EXAMPLE 7

Carrier A1 produced according to the method of Example 1 was classified through a 125 μm sieve, through which large particles of not smaller than 125 μm in size were removed. The thus-classified carrier was put into a fluidized bed airflow classifier 10 having a column diameter of 14 cm, as in FIG. 1, and hot air (115° C.) was introduced thereinto at a linear airflow rate of 20 cm/sec, with which the carrier 1 was fluidized for 10 hours. The thus-processed carrier is referred to as carrier J2. The observation of the carrier J2 with an electronic microscope revealed significant reduction in its surface roughness. The S value of the thus-processed carrier was 119, as in Table 2.

Durability Test (for peeling resistance of resin coat)

The carrier J2 was subjected to the durability test (for peeling resistance of resin coat). The data obtained are shown in Table 2.

EXAMPLE 8

Production of Carrier

The carrier A1 was classified through a 125 μm sieve, through which large particles of not smaller than 125 μm in size were removed. The thus-classified carrier was put into the fluidized bed airflow classifier 10, as in FIG. 1, and hot air (115° C.) was introduced thereinto at a linear airflow rate of 20 cm/sec, with which the carrier 1 was fluidized for 20 hours. The thus-processed carrier is referred to as carrier K2. The observation of the carrier K2 with an electronic microscope revealed significant reduction in its surface roughness. The S value of the thus-processed carrier was 110, as in Table 2.

Durability Test (for peeling resistance of resin coat)

The carrier K2 was subjected to the durability test (for peeling resistance of resin coat), like in Example 7. The data obtained are shown in Table 2.

EXAMPLE 9

Production of Carrier

Figure 2:
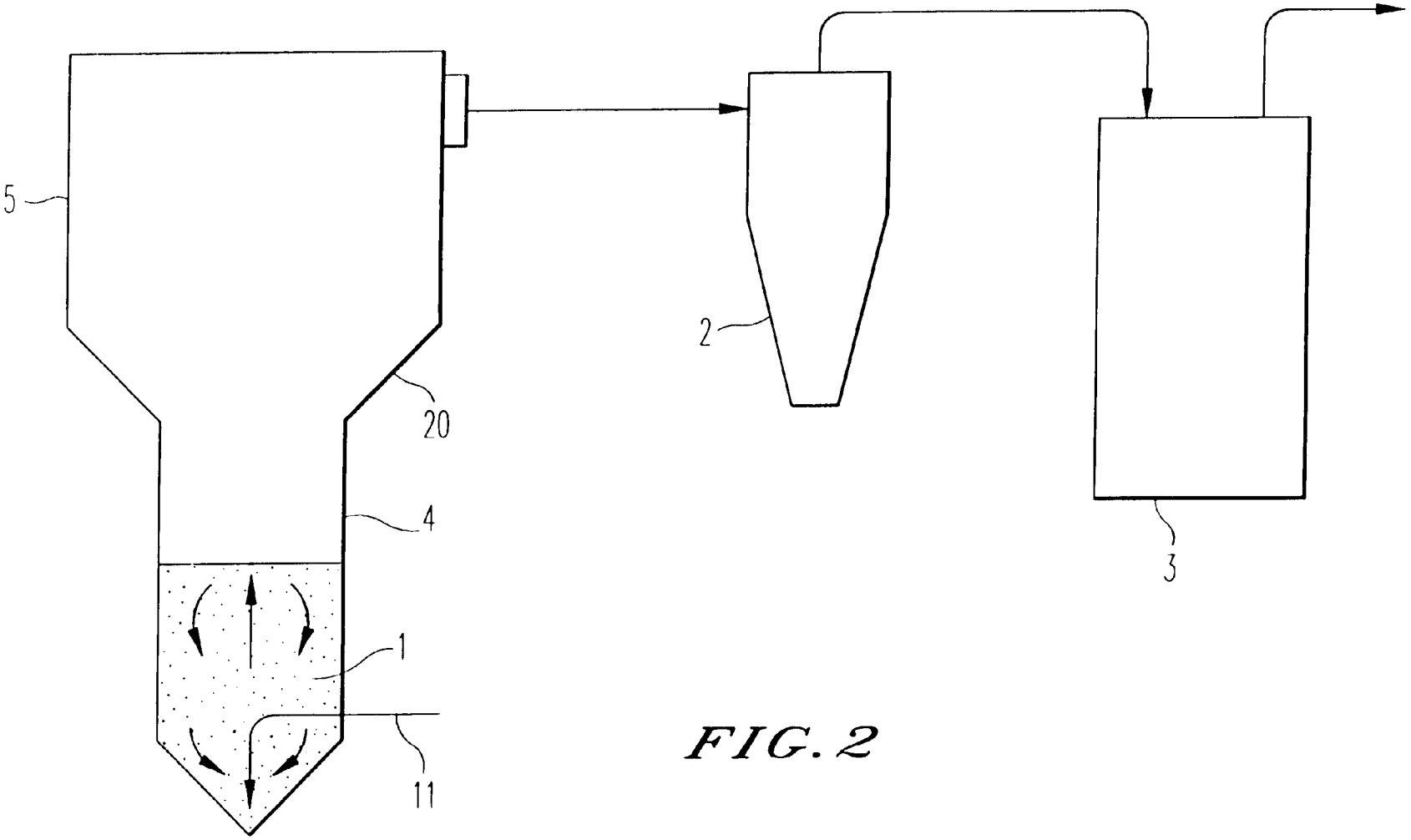
FIG. 2 is an explanatory view showing another example of surface treatment of the carrier for electrophotography of the invention.

The carrier A1 was classified through a 125 μm sieve, through which large particles of not smaller than 125 μm in size were removed. The thus-classified carrier was put into a fluidized bed airflow classifier 20 of which the upper empty part 5 was enlarged to have a diameter of 25 cm, as in FIG. 2, and hot air (115° C.) was introduced into the lower empty part 4 at a linear airflow rate of 40 cm/sec, with which the carrier 1 was fluidized for 5 hours. The thus-processed carrier is referred to as carrier L2. The observation of the carrier L2 with an electronic microscope revealed significant reduction in its surface roughness. The S value of the thus-processed carrier was 115, as in Table 2.

Durability Test (for peeling resistance of resin coat)

The carrier L2 was subjected to the durability test (for peeling resistance of resin coat), like in Example 7. The data obtained are shown in Table 2.

COMPARATIVE EXAMPLE 6

The carrier A1 was subjected to the durability test (for peeling resistance of resin coat), like in Example 7. The data obtained are shown in Table 2.

COMPARATIVE EXAMPLE 7

Production of Carrier

The carrier A1 was classified through a 125 μm sieve, through which large particles of not smaller than 125 μm in size were removed. The thus-classified carrier was put into the fluidized bed airflow classifier 10, as in FIG. 1, and air at room temperature was introduced thereinto at a linear airflow rate of 20 cm/sec, with which the carrier 1 was fluidized for 1 hour. The thus-processed carrier is referred to as carrier M2. The observation of the carrier M2 with an electronic microscope revealed little change in its surface roughness. The S value of the thus-processed carrier was 142, as in Table 2.

Durability Test (for peeling resistance of resin coat)

The carrier M2 was subjected to the durability test (for peeling resistance of resin coat), like in Example 7. The data obtained are shown in Table 2.

COMPARATIVE EXAMPLE 8

Production of Carrier

Polyethylene wax (Mitsui Hi-Wax, manufactured by Mitsui Petrochemical Co.) was dissolved under heat in toluene to prepare a 2% solution. This solution was applied onto a core material of a powdery sintered ferrite, F-300 (manufactured by Powdertec Co., having a mean particle size of 50 μm), using Spiracoater (manufactured by Okada Seiko Co.), whereby the core was coated with a coat of the resin of being 1.0% by weight relative to the core. The thus-obtained carrier is referred to as carrier N1. The S value of the carrier N1 was 122, as in Table 2.

Durability Test

The carrier N1 was subjected to the durability test (for peeling resistance of resin coat), like in Example 7. The data obtained are shown in Table 2.

TABLE 2

| | | | Durability rest | |
|---|---|---|---|---|
| | Carrier | S Value | Deposits on Doctor Blade | Peeling of Resin Coat |
| Example 7 | J2 | 119 | No | No |
| Example 8 | K2 | 110 | No | No |
| Example 9 | L2 | 115 | No | No |
| Comparative Example 6 | A1 | 148 | Yes | No |
| Comparative Example 7 | M2 | 142 | Yes | No |
| Comparative Example 8 | N1 | 122 | Yes | Yes |

As in Table 2, the carriers having an S value of larger than 130 (Comparative Examples 6 and 7) gave deposits on the doctor blade. The polyethylene wax-coated carrier (Comparative Example 8) gave deposits on the doctor blade, and its resin coat was peeled off. As opposed to those, the carriers with an S value of smaller than 130 as obtained in Examples of the invention produced no such phenomena, and were found to have good durability.

INDUSTRIAL APPLICABILITY

As has been described hereinabove, the present invention provides a carrier with good durability for electrophotography, of which the properties do not change in its long-term use so that the images formed using the carrier always have their original quality, and also provides a developer for electrophotography that comprises the carrier.

Accordingly, the developer for electrophotography of the invention is characterized in that the long-term use of the developer ensures good half-tone reproducibility without causing the change in the image density.

In the invention, used is a high-molecular polyolefin-based resin having a predetermined molecular weight as the coating resin. Therefore, the resin-coated carrier of the invention has good electrostatic characteristics, good spent resistance and good charge stability. Where the carrier is used in continuous copying systems, it always gives images of good quality without giving images of poor quality.

The coating resin used in the invention has a surface smoothness falling within a predetermined range. Therefore, during the use of the resin-coated carrier of the invention, the resin coat does neither peel off nor adhere to the doctor blades in developing machines.

We claim:

1. A carrier for electrophotography, comprising: a core coated with a high-molecular weight polyolefin-based resin which has been formed by directly polymerizing an olefinic monomer on the surface of the core, wherein the carrier core accounts for 90% by weight or more of the carrier and the carrier surface has a shape factor S (smoothness) satisfying the relation $100 \leqq S \leqq 128$, when represented by the following equation (I):

$$S=(L^2/A)\times(1/4\pi)\times 100 \quad \text{(I)}$$

wherein L represents an averaged value of the outer periphery of the projected image of each carrier particle, and A represents an averaged value of the projected area of each carrier particle.

2. The carrier for electrophotography as claimed in claim 1, in which the high-molecular polyolefin-based resin has a number-average molecular weight of 10,000 or more or a weight-average molecular weight of 50,000 or more.

3. The carrier for electrophotography as claimed in claim 1, in which the high-molecular weight polyolefin-based resin is a high-molecular weight polyethylene resin.

4. The carrier for electrophotography as claimed in any one of claims 1 to 3, in which the shape factor S (smoothness) of the carrier surface is attained by heating a carrier having a shape factor S of larger than 130 and/or giving a shock thereto.

5. The carrier for electrophotography as claimed in claim 1, of which the surface has a shape factor S (smoothness) satisfying the relation, $100 \leqq S < 115$, when represented by the following equation (I):

$$S=(L^2/A)\times(1/4\pi)\times 100 \quad \text{(I)},$$

wherein L represents an averaged value of the outer periphery of the projected image of each carrier particle, and A represents an averaged value of the projected area of each carrier particle.

6. A developer for electrophotography, which comprises the carrier of any one of claims 1 to 5, and a toner.

* * * * *